US011274891B2

(12) United States Patent
Stephens

(10) Patent No.: US 11,274,891 B2
(45) Date of Patent: Mar. 15, 2022

(54) SPEED LOADER

(71) Applicant: Brave Stephens, Austin, TX (US)

(72) Inventor: Brave Stephens, Austin, TX (US)

( * ) Notice: Subject to any disclaimer, the term of this patent is extended or adjusted under 35 U.S.C. 154(b) by 0 days.

(21) Appl. No.: 17/124,337

(22) Filed: Dec. 16, 2020

(65) Prior Publication Data

US 2021/0207906 A1 Jul. 8, 2021

Related U.S. Application Data

(60) Provisional application No. 62/958,137, filed on Jan. 7, 2020.

(51) Int. Cl.
*F41A 9/82* (2006.01)
*F41A 9/72* (2006.01)

(52) U.S. Cl.
CPC . *F41A 9/72* (2013.01); *F41A 9/82* (2013.01)

(58) Field of Classification Search
CPC ..... F41A 9/82; F41A 9/84
See application file for complete search history.

(56) References Cited

U.S. PATENT DOCUMENTS 211,691 A 1/1879 Bennett
4,509,284 A * 4/1985 Naber ..... F41A 9/83 42/87
4,756,110 A * 7/1988 Beltron ..... F41A 9/83 42/87
4,862,621 A * 9/1989 Kearney ..... F41A 9/83 42/87
7,866,080 B2 * 1/2011 Tucker ..... F41A 9/83 42/87

* cited by examiner

*Primary Examiner* — J. Woodrow Eldred
(74) *Attorney, Agent, or Firm* — Craige Thompson; Thompson Patent Law; Timothy D. Snowden

(57) ABSTRACT

Apparatus and associated methods relate to a firearm speed loader comprising (a) an elongated tube assembly for holding one or more ammunition cartridges in a central lumen defined by a wall of the tube assembly and (b) an elongated aperture formed in the wall of the tube assembly. In an illustrative example, two grooves may be formed into the wall distal to a proximal end of the tube assembly. One or more cartridges may be inserted into the central lumen by aligning the rim of each cartridge with the grooves. A user may place a digit of a hand into the central lumen and urge the cartridges from the proximal end to a distal end of the tube assembly, thereby causing the cartridges to be pushed from the tube assembly into the firearm. Various embodiments may advantageously reduce a time necessary to reload a firearm magazine.

20 Claims, 8 Drawing Sheets

SPEED LOADER

CROSS-REFERENCE TO RELATED APPLICATIONS

This application also claims the benefit of U.S. Provisional Application Ser. No. 62/958,137, titled "Speed Loader," filed by Brave Stephens, et al., on Jan. 7, 2020.

This application incorporates the entire contents of the foregoing application(s) herein by reference.

TECHNICAL FIELD

Various embodiments relate generally to a loading system and, more specifically, to a speed loading device for loading ammunition into a firearm.

SUMMARY

Apparatus and associated methods relate to a firearm speed loader comprising (a) an elongated tube assembly for holding one or more ammunition cartridges in a central lumen defined by a wall of the tube assembly and (b) an elongated aperture formed in the wall of the tube assembly. In an illustrative example, two grooves may be formed into the wall distal to a proximal end of the tube assembly. One or more cartridges may be inserted into the central lumen by aligning the rim of each cartridge with the grooves. A user may place a digit of a hand into the central lumen and urge the cartridges from the proximal end to a distal end of the tube assembly, thereby causing the cartridges to be pushed from the tube assembly into the firearm. Various embodiments may advantageously reduce a time necessary to reload a firearm magazine.

Various embodiments may achieve one or more advantages. For example, some embodiments may enable a non-repetitive process for loading a firearm magazine. Various embodiments may provide a digit chamber allowing a user to advantageously insert a digit such as a thumb into the central lumen through the elongated aperture. Various embodiments may advantageously orient the speed loader in a predetermined relationship to a firearm when an alignment element at the distal end of the speed loader engages a surface of the firearm. Various embodiments may enable a plurality of speed loaders to be pre-filled with cartridges and enable a shooter to rapidly refill a firearm.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, an exemplary firearm speed loading process is introduced with reference to FIG. 1A. Second, that introduction leads into a description with reference to FIGS. 1B-7 of some exemplary embodiments of a speed loader. Finally, the document discusses further embodiments, exemplary applications and aspects relating to speed loaders.

Figure 1A:
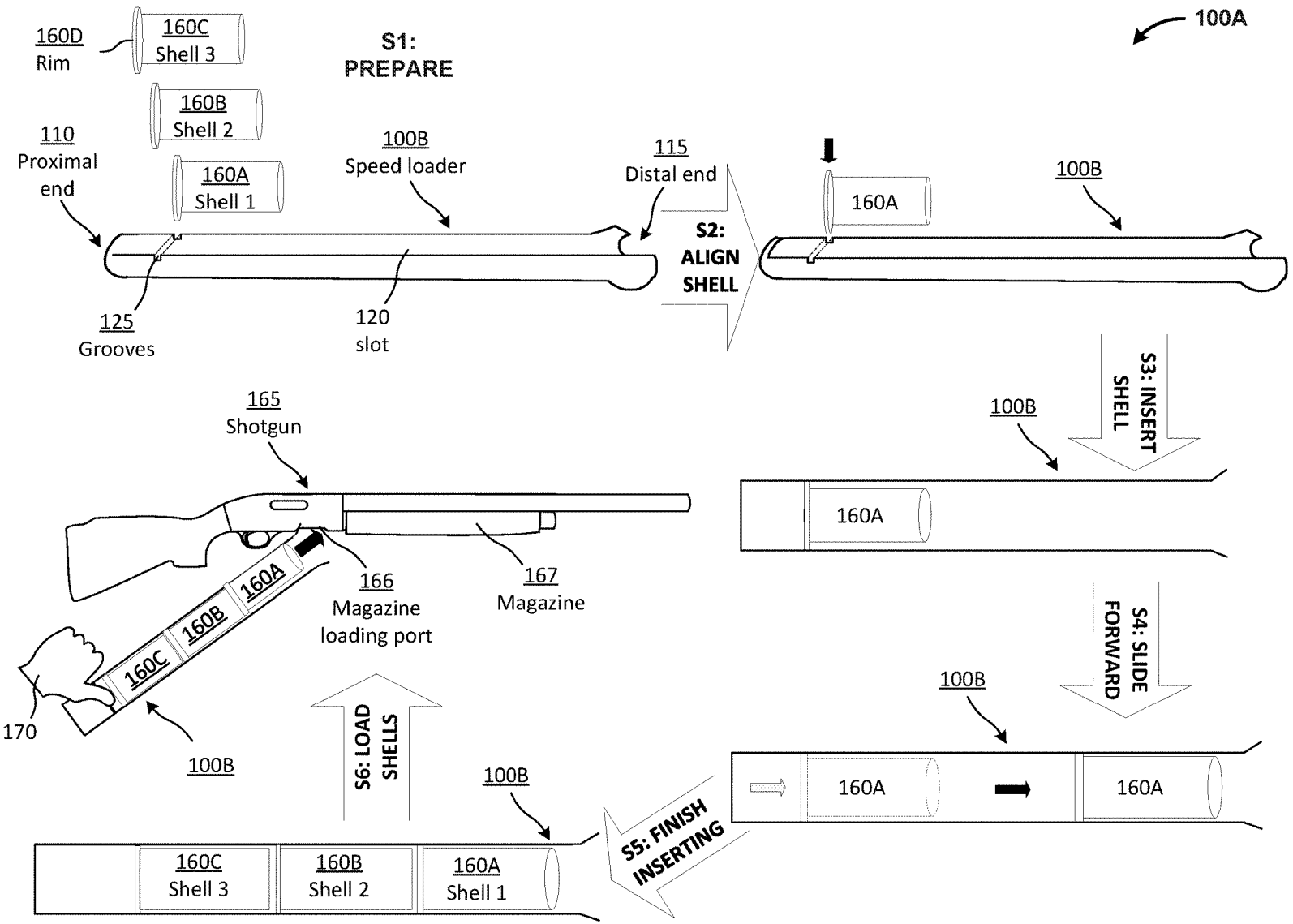
FIG. 1A depicts an exemplary sequential process for loading and unloading an exemplary speed loader in an illustrative use case.

FIG. 1A depicts an exemplary sequential process for loading and unloading an exemplary speed loader in an illustrative use case. An exemplary scenario 100A of using an exemplary speed loader 100B is shown in FIG. 1A. An exemplary architecture of the speed loader 100B is discussed in further detail with reference to FIG. 1B. In the depicted example, three ammunition cartridges are prepared to be loaded into the speed loader 100B. As depicted, the three cartridges are three shotgun shells: first shell 160A, second shell 160B, and third shell 160C. The speed loader 100B includes a slot 120 on a longitudinal tube assembly 105 (FIG. 1B) having a proximal end 110 and a distal end 115 and two grooves 125 (e.g., first groove 125A and second groove 125B depicted in FIG. 1B) on the wall of the tube 105. The two grooves 120 are close to the proximal end 110 of the tube. To load, for example, a user may begin with step S1 by preparing the speed loader 100B and the three shells 160A-160C. The user may, in step S2, hold the first shell 160A and align the rim 160D of the first shell with the two grooves. After aligning the edge of the rim of the 160A shell with the grooves 125, the user inserts the shell in step S3 by pressing the first shell 160A into a central lumen of the tube 105. Subsequently, in step S4, the loaded first shell 106A is urged towards the distal end 115 of the tube. The user then loads the second shell 160B and third shell 160C sequentially in step S5. After loading all the shells (e.g., 160A-160C) into the speed loader 100B, the user may hold the speed loader 100B towards a magazine loading port 166 of the firearm 165 and use a digit (e.g., thumb) of their hand 170 to urge the loaded shells 160A-160C distally in the speed loader 100B in step S6 to transfer the loaded shells 160A-160C through the distal end 115 into the magazine 167 of the firearm 165. By using the speed loader 100B, the user may toollessly load a number of shells into the firearm quickly.

Figure 1B:
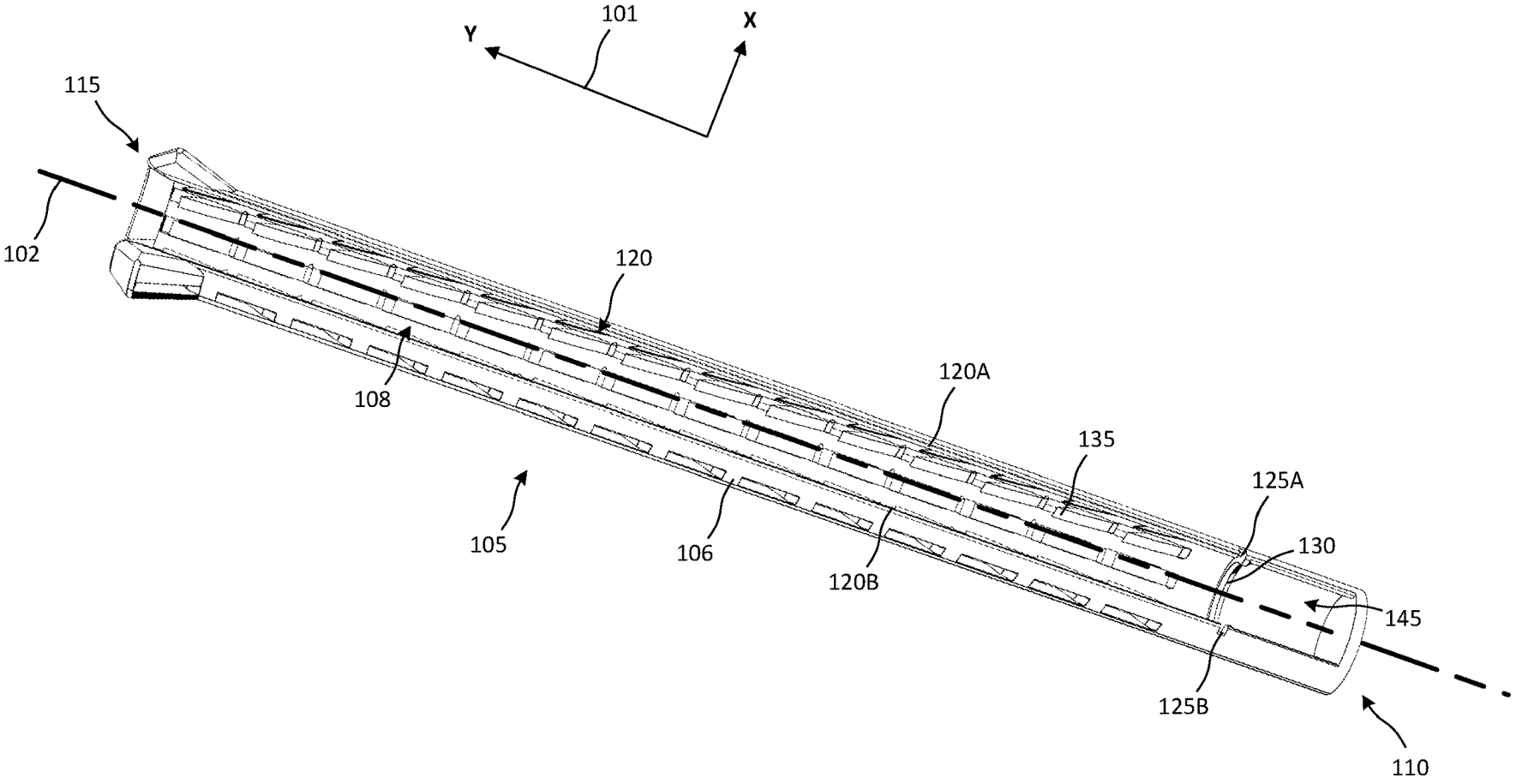
FIG. 1B depicts a perspective view of the exemplary speed loader.

FIG. 1B depicts a perspective view of an exemplary speed loader. In this depicted example, an exemplary speed loader 100B includes a tube assembly 105. The tube assembly 105, having a proximal end 110 and a distal end 115, includes an elongated tube wall 106. Tube wall 106 is generally annular in cross-section section, having a circular cross-section as depicted. Tube wall 106 forms a central lumen 108. Central lumen 108 may, for example, advantageously serve as a receptacle for ammunition cartridges. An elongated aperture 120 (e.g., a slot) is provided through the wall 106 of the tube assembly 105 and extends approximately from the proximal end 110 to the distal end 115. As depicted, the slot 120 is substantially parallel to the longitudinal axis 102 of the tube assembly 105. As depicted, the longitudinal direction along longitudinal axis 102 is indicated by the Y-axis of alignment axes 101 and the radial direction is indicated by the X-axis thereof. In the depicted embodiment, the slot 120 has a substantially uniform width between a first longitudinal edge 120A and a second longitudinal edge 120B, which are substantially parallel to longitudinal axis 102. In some embodiments, the slot 120 may have a width between edges 120A and 120B that is adapted to be greater than the width of a digit of a user's hand.

The tube assembly 105 also includes a first groove 125A and a second 125B formed into the two edges 120A and 120B, respectively, of the slot 120. In this depicted example, the speed loader 100B also includes a stopper 130, which is substantially annular in cross-section, arranged inside the elongated tube wall. The first stopper 130 includes two axial faces. A proximal axial face of the stopper 130 faces to the proximal end 110 of the tube assembly 105, and a distal axial face of the first stopper 130 faces the two grooves 125A and 125B towards distal end 115. The stopper 130 is aligned proximally to a proximal surface of the two grooves 125A and 125B. The stopper 130 cooperates with the wall 106 to define a digit chamber 141 between the proximal end 110 and a rim (e.g., 106D) of a cartridge when the cartridge is loaded into the central lumen 108. Accordingly, user may put a digit (e.g., thumb, finger) of their hand 170 into the digit chamber 141 and advantageously urge one or more cartridges in the central lumen 108 distally therein from the stopper 130 towards the distal end 115. The speed loader 100B may advantageously aid a user in toollessly loading a plurality of shells into a firearm quickly.

In some embodiments, the speed loader 100B also includes a plurality of ratchet elements 135 arranged on wall 106 and extending into central lumen 108 such that a cartridge therein may only be pushed from one direction (e.g., distally from the proximal end 110 to the distal end 115). For example, when a user loading cartridges into the central lumen 108 one by one, the loaded cartridges that are pushed towards the distal end may be positioned in situ and not slide back to the proximal end when the proximal end is in a lower position compared to the distal end caused by, for example, the user's posture. Other geometric configurations (e.g., flexible bumps, resilient members, a resilient lining) and/or relative dimensions may also be used to perform similar position retaining functions as the ratchet elements 135.

An exemplary proximal end and an exemplary enlarged distal end of the exemplary speed loader are discussed in further detail with reference to FIG. 2 and FIG. 3, respectively. In some embodiments, at least some portion of the edges 120A and 120B of slot 120 may be thickened. For example, the edges 120A and 120B may be thickened proximally to grooves 125A and 125B. In various embodiments, the grooves 125A and 125B may be formed, for example, by slotting a predetermined height and width into respective edges 120A and 120B of the wall 106 of tube assembly 105 such that cartridges may be inserted into the central lumen 108 when the rims (e.g., 106D with respect to FIG. 1A) of the cartridges are aligned with the grooves 125A/B. As a thickness of a distal portion of the edges 120A/B is not thickened, when the cartridges are loaded a user may advantageously urge the cartridge towards the distal end of the tube assembly 105. In addition, the ratchet members 135 may apply compressive pressures to the loaded cartridges in central lumen 108 such that the loaded cartridges advantageously remain in central lumen 108 until urged forward. Accordingly, the loaded cartridges may be compressively retained by ratchet members 135 such that the cartridges do not advertently fall out (or partially out) through the slot 120 or slide out through open distal end 115.

Figure 2:
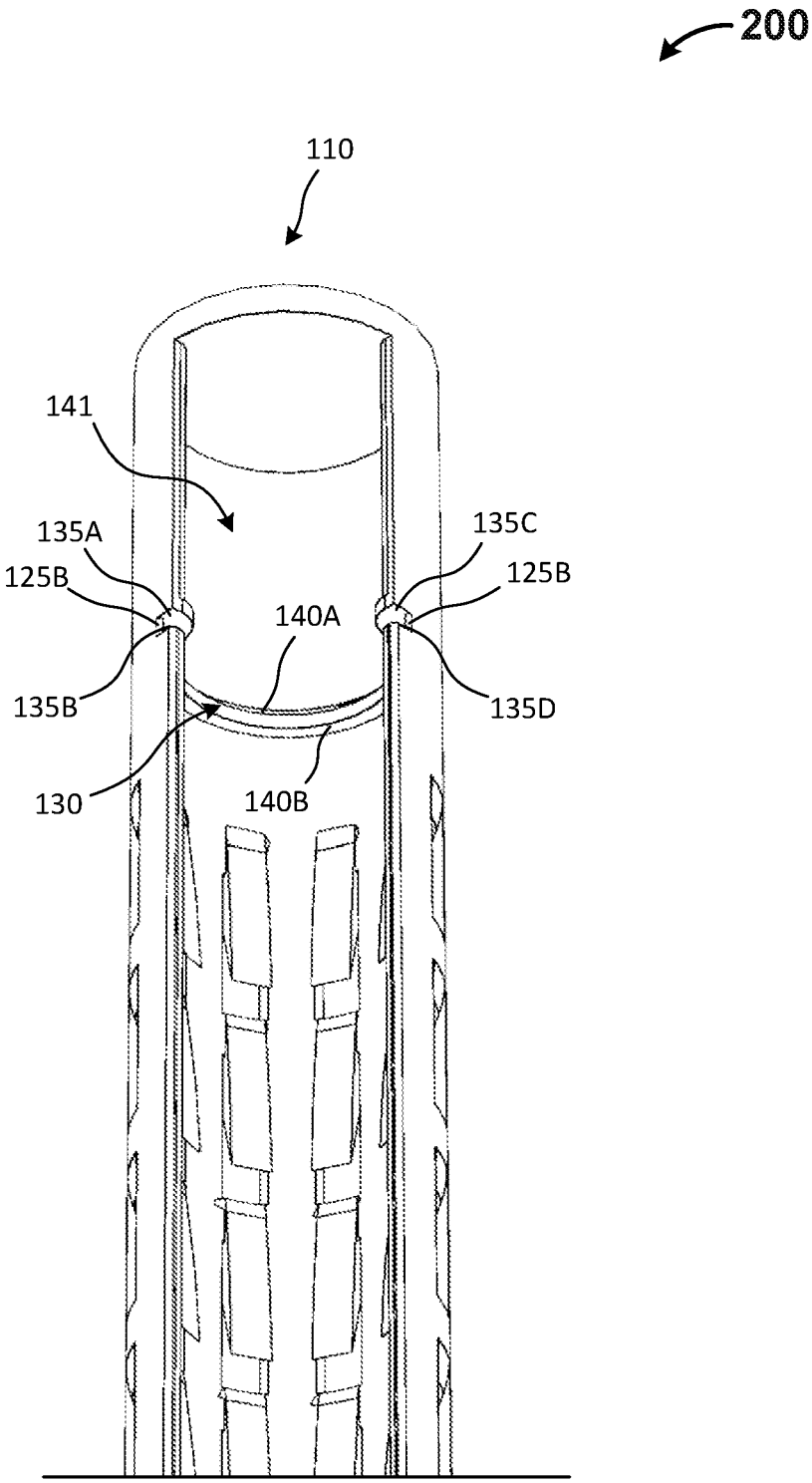
FIG. 2 depicts an enlarged view of a proximal end of the exemplary speed loader.

FIG. 2 depicts an enlarged view of a proximal end of the exemplary speed loader. As depicted in the close-up view 200 of this example, the first groove 125A includes a first sidewall 135A and a second sidewall 135B. The second groove 125B includes a third sidewall 135C and a fourth sidewall 135D. The first sidewall 135A and the third sidewall 135A are closer to the proximal end 110 than the second sidewall 135B and the fourth sidewall 135D. The stopper 130 includes a fifth sidewall 140A and a sixth sidewall 140B. The fifth sidewall 140A is closer to the proximal end 110 than the sixth sidewall 140B. The sixth sidewall 140B may be aligned with the first sidewall 135A and the third sidewall 135C.

When loading cartridges, a user may align the rim of the cartridge with the first and second grooves 125A-125B and press the rim of the shell into the lumen of the tube assembly 105. The digit chamber 141 is defined by the first stopper 130 and the proximal end 110. A user may then insert, for example, a finger (e.g., thumb) into the digit chamber 141 via a proximal portion of elongated aperture (e.g., slot) 120 to urge the loaded cartridges distally in the central lumen.

Figure 3:
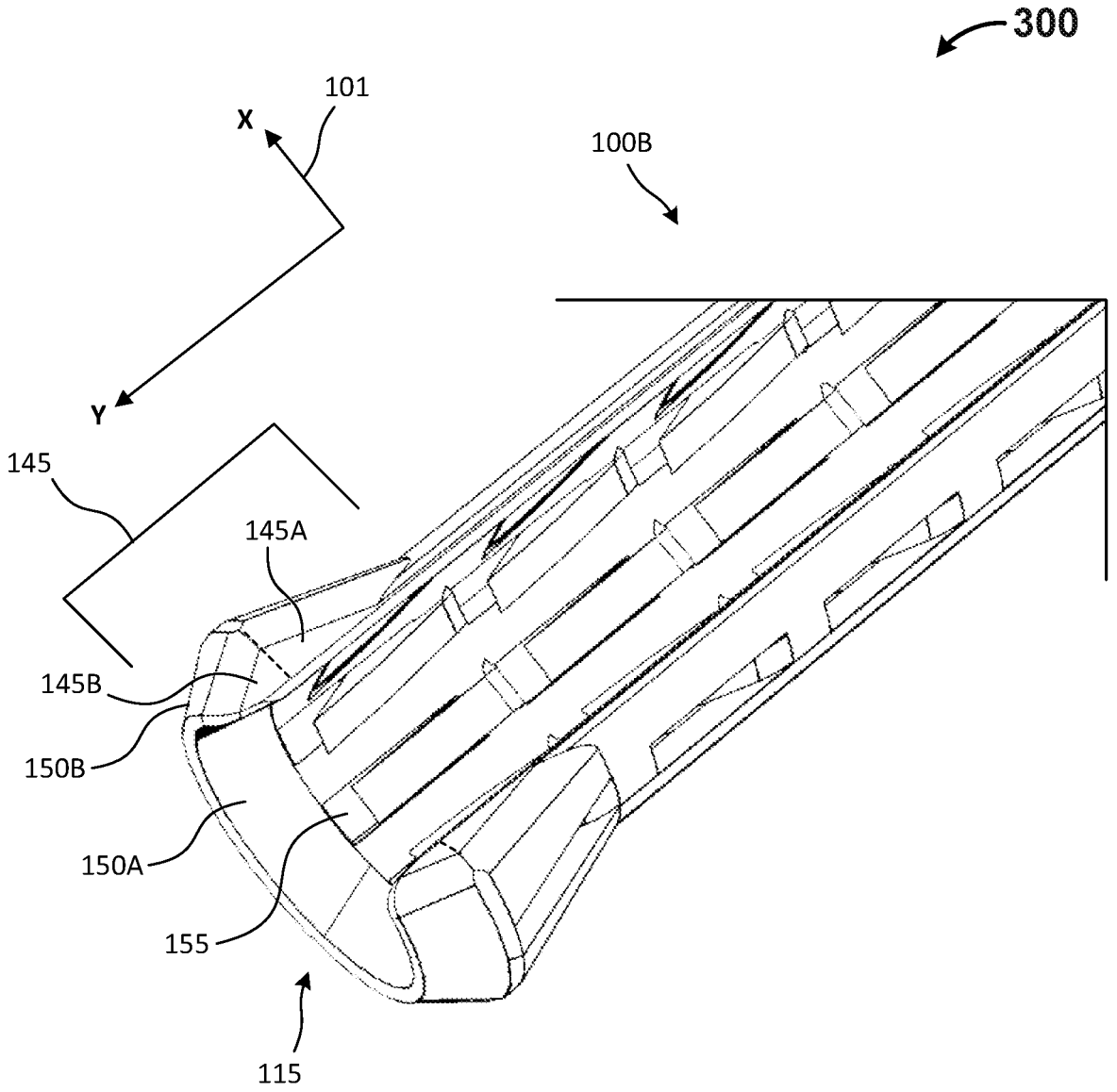
FIG. 3 depicts an enlarged view of a distal end of the exemplary speed loader.

FIG. 3 depicts an enlarged view of a distal end of the exemplary speed loader. As depicted in the close-up view 300 of this example, the distal end 115 includes an alignment feature 145 disposed on an outside surface of the tube assembly 105 such that a portion of the wall 106 near the distal end 115 is thicker. In some embodiments, the thickness of the alignment feature 145 is not substantially uniform. For example, as depicted, the alignment feature 145 includes a first portion 145A and a second portion 145B. The second portion 145B has an inner diameter defining an inner surface 150A of the second portion 145B, and an outer diameter defining an outer surface 150B of the second portion 145B. The first portion 145B and the outer surface 150B of the second portion 145B may have different slopes compared to the longitudinal axis 102 (parallel to the Y axis of alignment axes 101). In this depicted example, the first portion 145A has a positive slope compared to the longitudinal axis 102 and the outer surface 150B of the second portion 145B has a negative slope compared to the longitudinal axis. Using the alignment feature 145 may, by way of example and not limitation, advantageously reduce the chance of a user choking off the end of the speed loader. When transferring the shells to the magazine, feeling the alignment feature 145 may also, for example, advantageously indicate to the user the end of the transferring process and the distal end of the speed loader 100B such that the user may slow down the transferring speed.

In some embodiments, the diameter of the inner surface 150A may be not uniform. For example, the inner surface 150A may have a positive slope relative to the longitudinal axis such that the outlet from the speed loader to the magazine of the shotgun is enlarged. For example, the angle between the inner surface 150A and the longitudinal axis may be 35 degrees. Accordingly, a user may transfer cartridges from the speed loader to the magazine of the shotgun more effortlessly.

In some embodiments, the speed loader 100B may include one or more apertures 155 through the wall 106 of the tube assembly 105. The apertures 155 may, for example, be formed during a process of generating corresponding ratchet elements 135. The generation of apertures 155 may, in some embodiments, advantageously reduce a total weight of the speed loader 100B. In some embodiments, the ratchet elements 135 may be generated by other methods such that no openings would be formed in the wall 106 of the tube assembly 105. The material of the ratchet elements 135 may be the same with or different from the material of the tube assembly 105. The tube assembly 105 may be formed by, for example, at least partially of plastic and/or metal (e.g., aluminum). For example, when the speed loader 100B is made with plastic, the total cost of the speed loader 100B may be advantageously reduced. In some embodiments, the speed loader 100B may be formed by an additive manufacturing process (e.g., 3D printing) to form a single unitary body requiring no assembly.

Figure 4:
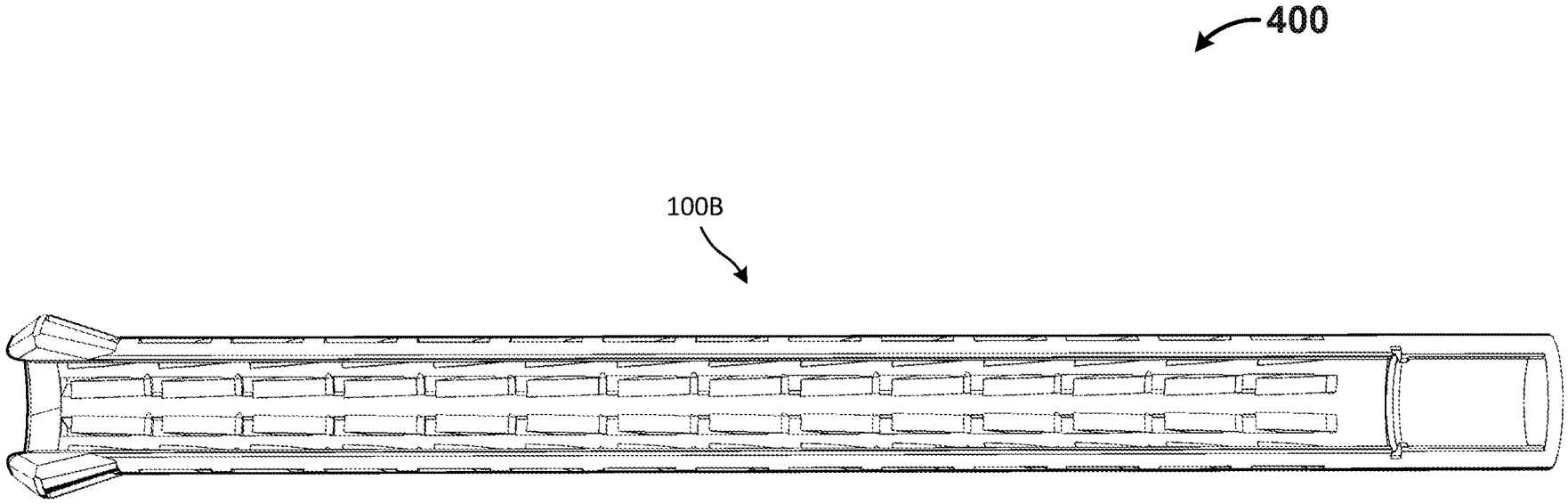
FIG. 4 depicts a top view of the exemplary speed loader.
Figure 5:
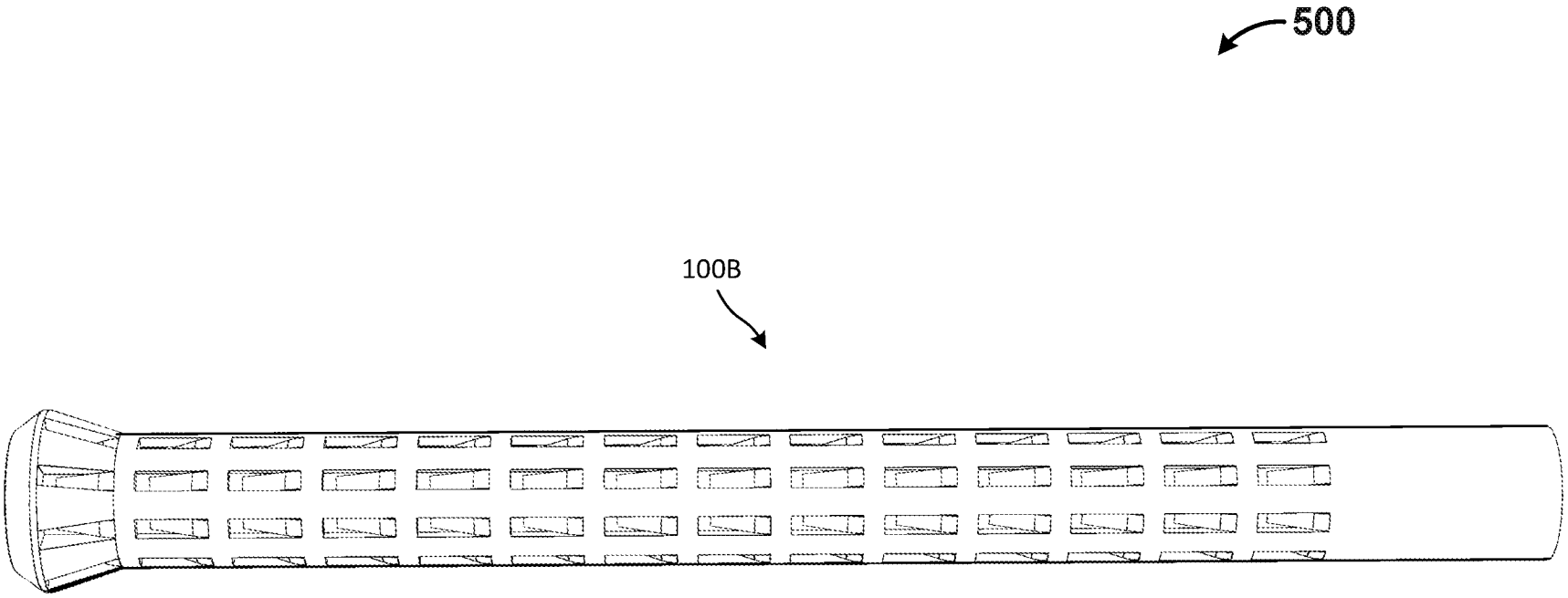
FIG. 5 depicts a bottom view of the exemplary speed loader.

FIG. 4 depicts a top view of the exemplary speed loader. The top view 400 depicts, for example, the elongated aperture, digit chamber, and stopper of speed loader 100B. FIG. 5 depicts a back view of the exemplary speed loader. The back view 500 depicts, for example, the ratchet elements formed in the wall of the speed loader 100B distal to the digit chamber.

Figure 6:
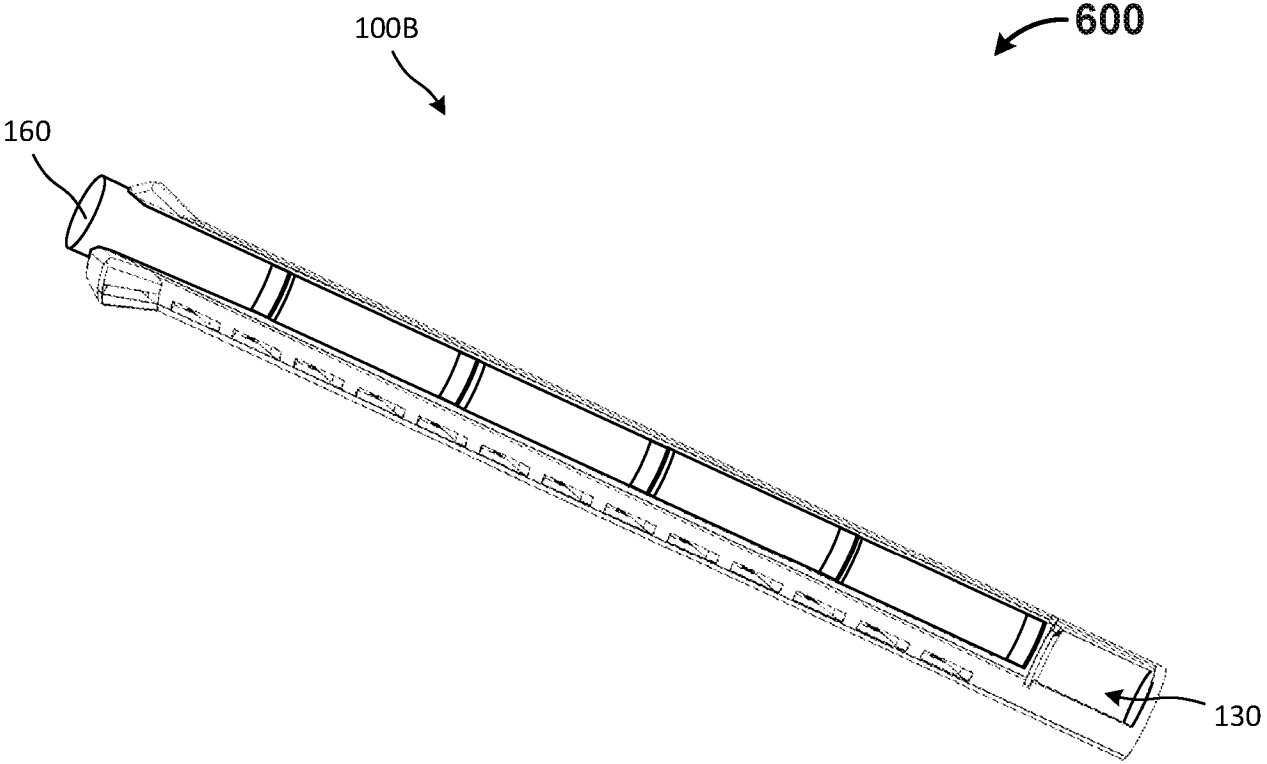
FIG. 6 depicts a perspective view of an exemplary speed loader with exemplary ammunition cartridges inserted therein in preparation for loading.

FIG. 6 depicts a perspective view of an exemplary speed loader with shells. In this depicted example, the speed loader is designed to hold five shotgun shells 160. In some other embodiments, the size (e.g., diameter(s) radius(es), the length(s)) of the tube assembly 105, the speed loader 100B, and/or various components thereof, may be predetermined to advantageously receive and dispense different sizes, geometries and/or different quantities of cartridges.

Figure 7:
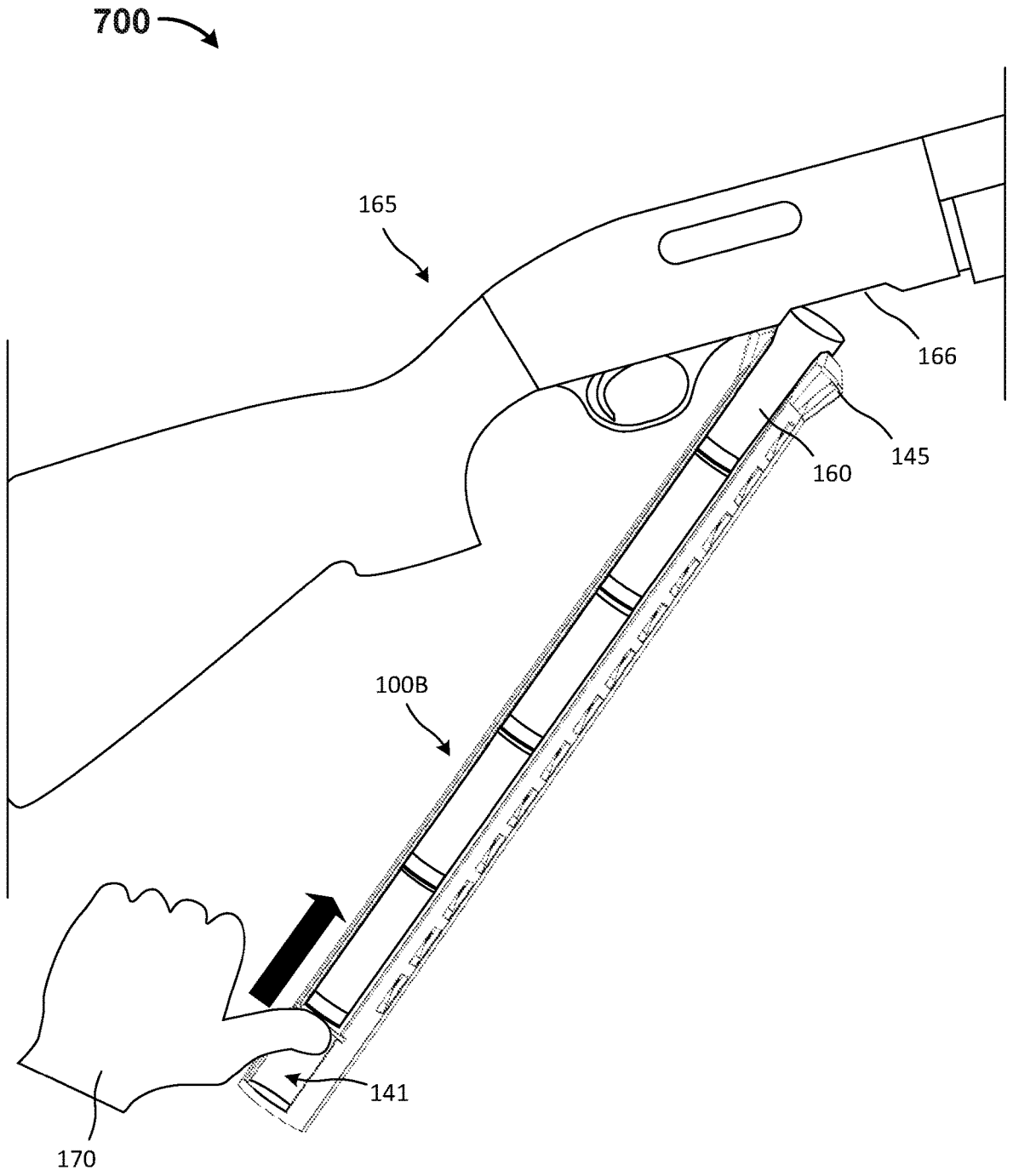
FIG. 7 depicts a schematic view of the exemplary speed loader in an exemplary position to load ammunition cartridges into a firearm.

FIG. 7 depicts a schematic view of the exemplary speed loader in position to load shells into a shotgun. In the depicted illustrative use case 700, the distal end of the speed loader 100B is placed against a surface of the firearm 165 just rearwards (e.g., towards a stock of the firearm) of the magazine loading port 166. The alignment feature 145 engages with the surface of the firearm 165 such that the speed loader 100B is oriented at a predetermined angle relative to the firearm (e.g., relative to a longitudinal axis of a barrel and/or magazine of the firearm). A user inserts a digit (e.g., a thumb) of their hand 170 into digit chamber 141 and urges loaded cartridges 160 into magazine loading port 166.

In various embodiments a user may, by way of example and not limitation, with one hand grasp both the firearm and align the distal end of the speed loader 100B, and with a second hand hold the speed loader and dispense cartridges therefrom into the firearm. Accordingly, a user may advantageously quickly and smoothly load a plurality of cartridges into a magazine of a firearm in a non-repetitive process. For example, a user may have one or more speed loaders 100B pre-loaded with cartridges and dispense them as desired into a firearm in a fraction of the time required to load the cartridges into the firearm singly in a repetitive process.

Although various embodiments have been described with reference to the figures, other embodiments are possible. For example, the color, size, and/or weight of the speed loader may be customized to contain different cartridges (e.g., shotgun shells, rifle cartridges, handgun cartridges) and/or used for different firearms (e.g., shotguns, rifles, handguns).

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. An apparatus comprising:

an elongated tube assembly comprising:

a wall defining a central lumen opening at a distal end of the elongated tube assembly, the central lumen having a substantially constant radius about a longitudinal axis;

an elongated aperture formed in the wall of the elongated tube assembly between the distal end and a proximal end thereof, the elongated aperture oriented substantially parallel to the longitudinal axis and having a first linear edge and a second linear edge; and, a first groove in the first linear edge and a second groove in the second linear edge, the grooves being aligned in a plane normal to the longitudinal axis and communicating with the elongated aperture to define a rim access aperture into the central lumen, wherein:

the elongated aperture is configured to receive at least one ammunition cartridge into the central lumen when a rim thereof is inserted in the rim access aperture, the radius of the central lumen is at least equal to a radius of a body of the cartridge, a width of the elongated aperture is at least equal to the radius of the cartridge body, and a width of the rim access aperture is at least equal to a diameter of a rim of the cartridge, and the elongated tube assembly is configured such that the at least one cartridge is urged distally by a force applied longitudinally and initiated from a proximal digit chamber sized to receive an operator's thumb.

2. The apparatus of claim 1, wherein the elongated tube assembly is configured such that when the distal end is placed against a loading port of a firearm magazine, and the at least one cartridge is urged distally, the at least one cartridge is thereby transferred into the firearm magazine as the operator's thumb travels distally in the central lumen via the elongated aperture.

3. The apparatus of claim 1, wherein a thickness of the wall monotonically increases for a predetermined distance proximal to the distal end.

4. The apparatus of claim 3, wherein the monotonically increasing thickness forms an outer alignment surface terminating at the distal end and configured such that when the outer alignment surface is pressed against a face of a firearm it orients the longitudinal axis of the central lumen at a predetermined angle relative to the face.

5. The apparatus of claim 4, wherein the outer alignment surface is configured with a positive slope relative to the longitudinal axis.

6. The apparatus of claim 1, the elongated tube assembly further comprising a plurality of depressible ratchet elements extending into the central lumen.

7. The apparatus of claim 6, wherein each of the plurality of depressible ratchet elements are configured to depress when the cartridge travels through the central lumen towards the distal end and away from the proximal end, and to stop the cartridge attempting to travel away from the proximal end towards the distal end.

8. The apparatus of claim 6, wherein each of the plurality of depressible ratchet elements are formed as a portion of the wall attached at a base of the ratchet element and having a tip extending into the central lumen.

9. An apparatus comprising:

an elongated tube assembly comprising:

a wall defining a central lumen having an annular cross-section and opening at a distal end of the elongated tube assembly;

an elongated aperture formed in the wall of the elongated tube assembly between the distal end and a proximal end thereof, the elongated aperture oriented substantially parallel to a longitudinal axis and having a first linear edge and a second linear edge; and, a first groove in the first linear edge and a second groove in the second linear edge, the grooves being aligned in a plane normal to the longitudinal axis and communicating with the elongated aperture to define a rim access aperture into the central lumen, wherein the elongated aperture is configured to receive at least one ammunition cartridge into the central lumen when a rim thereof is inserted in the rim access aperture.

10. The apparatus of claim 9, wherein a radius of the central lumen is at least equal to a radius of a body of the cartridge.

11. The apparatus of claim 10, wherein a width of the elongated aperture is at least equal to the radius of the cartridge body.

12. The apparatus of claim 10, wherein a width of the rim access aperture is at least equal to a diameter of a rim of the cartridge.

13. The apparatus of claim 9, wherein the elongated tube assembly is configured such that when the distal end is placed against a loading port of a firearm magazine, and the at least one cartridge is urged distally by a force applied longitudinally and initiated from a proximal digit chamber sized to receive a digit of an operator's hand, the at least one cartridge is thereby transferred into the firearm magazine as the digit travels distally in the central lumen via the elongated aperture.

14. The apparatus of claim 9, wherein a thickness of the wall monotonically increases for a predetermined distance proximal to the distal end.

15. The apparatus of claim 14, wherein the monotonically increasing thickness forms an outer engagement surface terminating at the distal end and configured such that when the outer engagement surface is pressed against a face of a firearm it orients the longitudinal axis of the central lumen at a predetermined angle relative to the face.

16. The apparatus of claim 15, wherein the outer engagement surface is configured with a positive slope relative to the longitudinal axis.

17. The apparatus of claim 9, the elongated tube assembly further comprising a plurality of depressible ratchet elements extending into the central lumen.

18. The apparatus of claim 17, wherein each of the plurality of depressible ratchet elements are configured to depress when the cartridge travels distally through the central lumen, and to stop the at least one cartridge attempting to travel proximally therethrough.

19. The apparatus of claim 17, wherein each of the plurality of depressible ratchet elements are formed as a portion of the wall attached at a base of the ratchet element and having a tip extending into the central lumen.

20. The apparatus of claim 9, wherein a stopper element is disposed within the central lumen proximal to the first groove and the second groove and configured to prevent proximal movement of the cartridge.

* * * * *